US007806068B2

(12) United States Patent
Ulgen

(10) Patent No.: US 7,806,068 B2
(45) Date of Patent: Oct. 5, 2010

(54) RUDDER FOR MARINE VEHICLES

(76) Inventor: Mehmet Nevres Ulgen, Mete Cad. No: 26 Necip Akar Ishani Taksim, Istanbul (TR) 80900

( * ) Notice: Subject to any disclaimer, the term of this patent is extended or adjusted under 35 U.S.C. 154(b) by 0 days.

(21) Appl. No.: 12/122,831

(22) Filed: May 19, 2008

(65) Prior Publication Data

US 2008/0289556 A1 Nov. 27, 2008

(30) Foreign Application Priority Data

May 25, 2007 (TR) ..... 2007 03602

(51) Int. Cl.
*B63H 25/06* (2006.01)

(52) U.S. Cl. ..... 114/162

(58) Field of Classification Search ..... 114/162, 114/163; 440/41, 42, 43
See application file for complete search history.

(56) References Cited

U.S. PATENT DOCUMENTS 3,752,105 A * 8/1973 Hackett ..... 114/162
3,982,494 A * 9/1976 Posti ..... 440/41
5,046,441 A * 9/1991 Kanazaki ..... 114/165
5,167,547 A * 12/1992 Kobayashi et al. ..... 440/42

* cited by examiner

*Primary Examiner*—Lars A Olson
(74) *Attorney, Agent, or Firm*—Vidas, Arrett & Steinkraus P.A.

(57) ABSTRACT

A rudder (1) adaptable to a rudder shaft (4) in a rudder mechanism for changing the direction of motion of a marine vehicle. The rudder (1) is provided at least one drive unit (2) for the rotation of the rudder (1) around an axis substantially vertical to the lateral surfaces of the rudder (1)

1 Claim, 1 Drawing Sheet

RUDDER FOR MARINE VEHICLES

FIELD OF INVENTION

The present invention relates to a rudder having a drive unit which enhances the control capability thereof and thus facilitating maneuverability of marine vehicles such as vessels, boats, etc as they move backwards.

BACKGROUND OF INVENTION

Steering devices are provided at the rear side of marine vehicles such as vessels to change the direction of movement both in forward and backward directions while maneuvering, such devices consist mainly of an arm, a shaft, and a rudder In a typical shaft-rudder construction, vertical axis of the rudder shaft becomes positioned on the front of the rudder when the marine vehicle moves forward, and since the area on the rudder's front section that is exposed to water load during forward motion is relatively small, the rudder can be easily controlled. In other words, since no rudder area is left on the front of the rudder shaft while moving forward, water cannot exert force on such 'non-present' area, which provides an easy control of steering attempts of the vessel.

The preceding condition, however, is much different as such vessel moves backward. In other words, the vertical axis of the rudder shaft becomes positioned on the rear with respect to the rudder's surface area, exposing the rudder's area to water load when the vessel moves backward, and making difficult to control the rudder and exposing the mechanical components thereof to external forces.

DESCRIPTION OF INVENTION

The object of the present invention is to enhance the maneuverability of marine vehicles such as boats, vessels, etc while they move backward and to maintain the stability of mechanical connections of the rudder by minimizing the water load on the surface of the rudder This object is achieved by a rudder having at least one drive unit which allows the rudder to be rotated around an axis substantially vertical to the lateral surfaces of the rudder.

In a preferred embodiment of the present invention, the drive unit is a hydraulic piston connected from one end to the rudder and from other end to a connection piece of the rudder.

The rudder according to the present invention is rotatably jointed to the connection piece so as to rotate the rudder with respect to the piece

BRIEF DESCRIPTION OF FIGURES

The present invention is to be evaluated together with annexed figures briefly described hereunder to make clear the subject embodiment and the advantages thereof.

REFERENCE NUMBERS OF PARTS IN FIGURES

1 Rudder
2 Drive unit
3 Connection piece
4 Shaft
5 Rudder joint
6 Piston joint

DETAILED DESCRIPTION OF INVENTION

First of all, the term "marine vehicle" used throughout this description should be understood to cover any kind of marine vehicles such as boats, vessels, etc.

Figure 1:
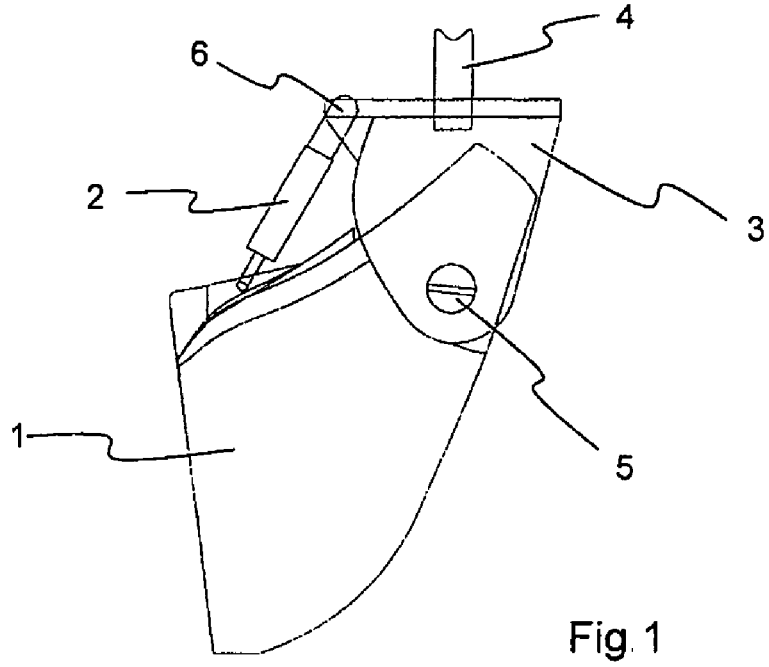
FIG. 1 illustrates a position of the rudder before driving the same.

The rudder (1) of the invention is rotatably connected by means of a rudder joint (5) to a connection piece (3). The rudder connection piece (3) is adapted to a shaft (4) extending upward In practice, FIG. 1 illustrates the case of a forward-moving marine vehicle in which the rudder's (1) surface area behind the axis of shaft with respect to motion of direction of the vehicle and being exposed to water Thus, the maneuverability of marine vehicle can be easily achieved in the forward direction.

Figure 2:
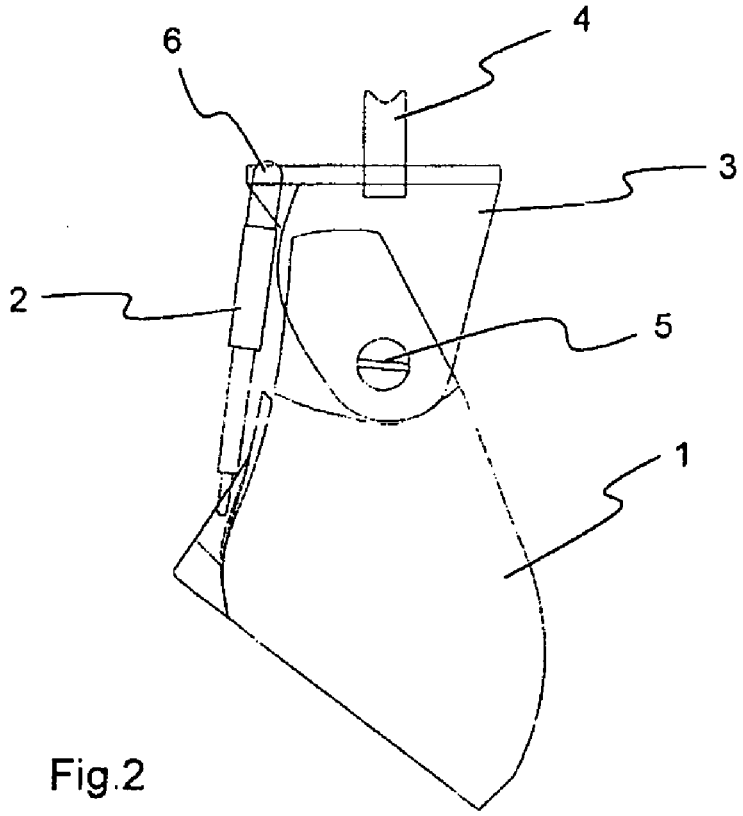
FIG. 2 illustrates a position of the rudder after driving the same.

FIG. 2, on the other hand, illustrates the rudder (1) when the marine vehicle moves backward. FIG. 2 further illustrates the rudder drive unit (2), preferably a piston, which is connected to the rudder (1) from one end and to the frame connection piece (3) from the other end. Since the rudder drive unit (2) in FIG. 2 is actuated, the rudder (1) is rotated around the joint (5) and the surface area of the rudder (1) contacting water behind the axis of the shaft becomes now relatively reduced, as the marine vehicle moves backward So the rudder (1) is achieved to be easily controlled.

The connection between the rudder connection piece (3) and the drive unit (2) of the rudder comprises a joint (6) allowing the drive unit (2) to perform axial rotations around the connection point It will be appreciated that the drive unit (2) can be pivotally connected to the rudder (1) by means of a similar joint means.

The drive unit (2) according to the invention can also be an entirely mechanical arrangement or a pneumatic arrangement or a combination thereof in other configurations in addition to hydraulic pistons.

The invention claimed is:

1. A rudder (1) for changing the direction of motion of a marine vehicle, which rudder is adaptable to a rudder shaft (4) having an axis; said rudder (1) having opposing lateral surfaces each defining a surface area of said rudder, said rudder being rotatable by a drive unit (2) around an axis substantially vertical to the lateral surfaces of the rudder (1), wherein the rudder (1) is actuated to rotate in a manner that the surface area of the rudder (1) behind the axis of shaft (4) is greater than the surface area of the rudder (1) in front of the axis of shaft (4) when said marine vehicle moves forward and is actuable to rotate such that the surface area of the rudder behind the axis of shaft (4) is smaller than the surface area of the rudder in front of the shaft when said marine vehicle moves in reverse.

* * * * *